United States Patent [19]

Ohara et al.

[11] 4,187,484

[45] Feb. 5, 1980

[54] TIMING DEVICE UTILIZING A UNIQUE CLUTCH ASSEMBLY

[75] Inventors: Isamu Ohara, Okayama; Tsutomu Muranaka, Tamano; Hideo Eizumi, Okayama, all of Japan

[73] Assignee: Omron Tateisi Electronics Co., Kyoto, Japan

[21] Appl. No.: 839,304

[22] Filed: Oct. 4, 1977

[30] Foreign Application Priority Data

| | | | |
|---|---|---|---|
| Oct. 12, 1976 | [JP] | Japan | 51-122559 |
| Mar. 9, 1977 | [JP] | Japan | 52-26381 |
| May 23, 1977 | [JP] | Japan | 52-59592 |

[51] Int. Cl.[2] ..... H01H 3/54

[52] U.S. Cl. ..... 335/75; 335/68

[58] Field of Search ..... 335/68–76, 335/59, 65, 118

[56] References Cited

U.S. PATENT DOCUMENTS

| | | | |
|---|---|---|---|
| 3,611,216 | 10/1971 | Matsuo et al. | 335/68 |
| 3,693,119 | 9/1972 | Nakama et al. | 335/69 |
| 4,080,583 | 3/1978 | Fusita | 335/75 |

FOREIGN PATENT DOCUMENTS

| | | |
|---|---|---|
| 1960248 | 7/1970 | Fed. Rep. of Germany . |
| 2230434 | 2/1973 | Fed. Rep. of Germany . |
| 2453889 | 5/1975 | Fed. Rep. of Germany . |

*Primary Examiner*—Harold Broome

*Attorney, Agent, or Firm*—Stevens, Davis, Miller & Mosher

[57] ABSTRACT

A timing device is provided with a synchronous motor for rotating a driven gear containing a cam member through a predetermined angle corresponding to a selected time period, a clutch mechanism including an arm supporting a pair of gears on a common shaft for coupling the synchronous motor to the driven gear and further including a means for keeping a first gear of the pair in continuous engagement with the driven gear, a plurality of leaf switches for selectively energizing or de-energizing the synchronous motor, an actuator cooperating with the cam member for controlling the leaf switches, an electromagnetic device coupled to the clutch arm and actuator for controlling their movements to couple the synchronous motor to a second gear of the pair and to control the starting of the timing interval, and a means for initially providing an angular rotation to the driven gear to set the selected time period.

9 Claims, 12 Drawing Figures

TIMING DEVICE UTILIZING A UNIQUE CLUTCH ASSEMBLY

CROSS REFERENCE TO RELATED APPLICATIONS

This application is related to the subject matter described and claimed in Ser. No. 839,302 filed Oct. 4, 1977 in the name of Ohara et al entitled "Unique Timing Device Construction."

BRIEF SUMMARY OF INVENTION

This invention relates to a synchronous motor driven timing device, and more particularly to a timing device having a geared clutch means.

Prior art timing devices equipped with a clutch means for transmitting the drive force of a motor to a driven gear are illustrated in FIGS. 7*a* and 7*b*. In FIG. 7*a* the clutch means comprises a shaft 192, and gears 93*a* and 93*b* attached to opposite ends of the shaft 192; the gear 93 being engaged with a drive gear 95 and the gear 93*b* being engageable upon actuation of the clutch means with a driven gear 90. The clutch means shown in FIG. 7*b* comprises a shaft 92*a* made of flexible material, for example, a coil spring, and a gear 93*b* engageable upon actuation of the clutch means with a driven gear 90. Shaft 92*a* is directly attached at one end to a motor 194, while the gear 93*b* is mounted to the other end of the shaft 92*a*.

In both prior art clutch mechanisms to gear 93*b* moves swingingly when actuated and the engagement of the gear 93*b* with the driven gear 90 is not positive or very stable. Additionally, because of the movement required for coupling of gear 93*b* with driven gear 90, the shafts 92 and 92*a* need to be of substantial length resulting in the clutch means occupying an unduly large amount of space.

Accordingly, an object of the invention is to provide an improved clutch means which more positively couples the motor to a driven gear in a timing device.

Another object of the invention is to provide an improved clutch device which has a more stable operating movement between engaging and disengaging positions.

An additional object of the invention is to provide a clutch mechanism which occupies a relatively small amount of space, thereby reducing the overall space requirement of a timing device.

These and other advantages are obtained through the provision of a clutch means incorporating a pivotable support arm for carrying first and second gears concentrically mounted on a common shaft. During pivoted movement of the support arm and common shaft, a first gear of the pair continuously engages a driven gear while the second gear selectively engages with a drive gear of a synchronous motor. The support arm is normally biassed towards a first position of engagement of the second gear with the drive gear, but is urged out of the first position by an armature of an electromagnetic coil. Thus, operation of the electromagnetic coil serves to engage the clutch means to couple the second gear with the drive gear.

In a particularly preferred form of the invention at least one projection is mounted on the support arm to positively hold the first gear to the driven gear. Further projections may also be provided on the support arm to prevent its inclination or tilting during engaging and disengaging movements of the clutch means.

The nature of the invention, including the foregoing and other objects and novel features, will be more fully appreciated from the following detailed description when taken in conjunction with the accompanying drawings.

DESCRIPTION OF THE PREFERRED EMBODIMENT

Figure 1:
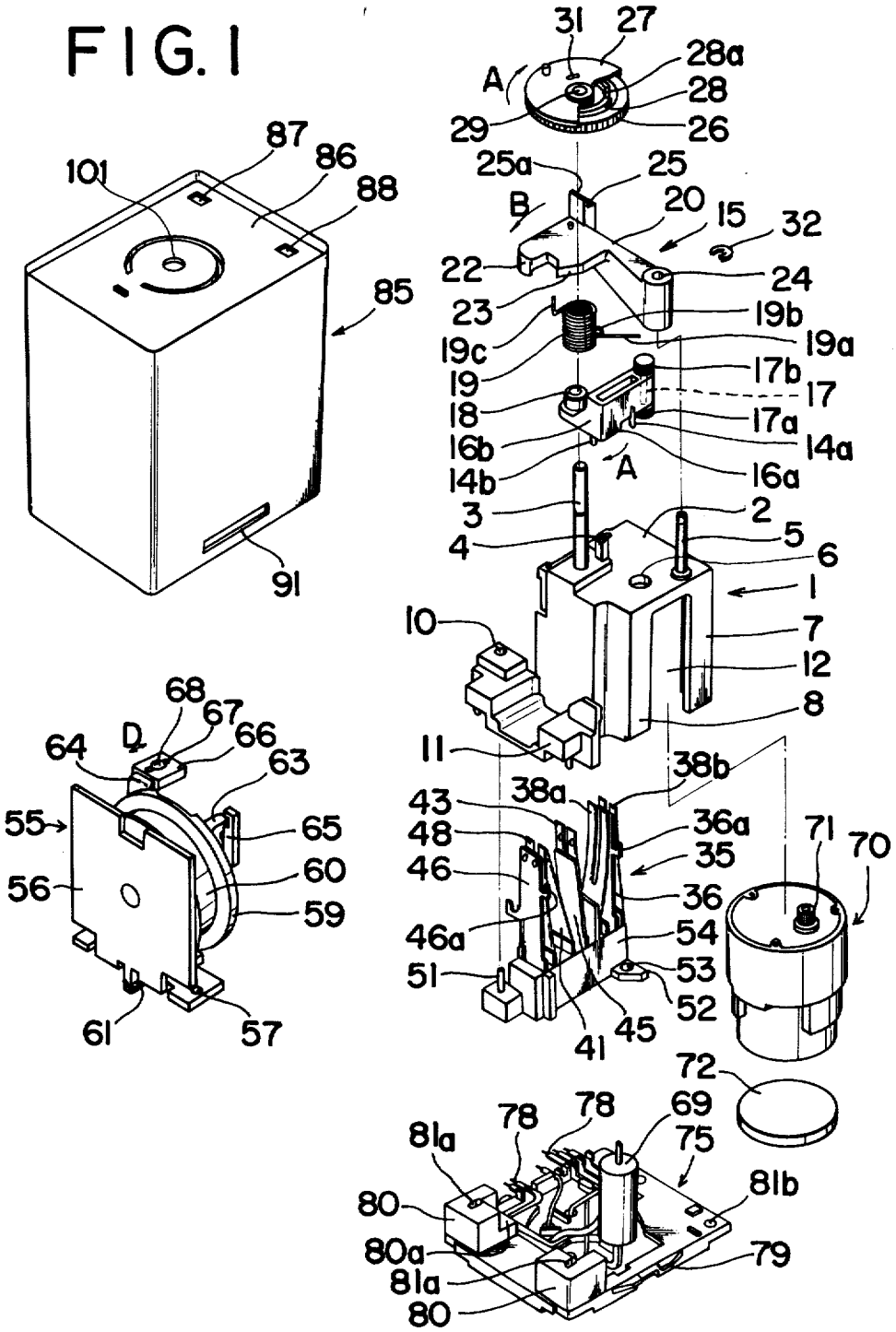
FIG. 1 is an exploded view of an improved timing device, constructed in accordance with the teachings of this invention.

Referring to the drawings and particularly to FIGS. 1–5, a molded frame 1 is provided including a mounting base 2 for mounting a contact actuator 15, supporting portions 7 and 8, and attaching portions 9 and 11 (FIG. 5) respectively attaching terminal holder 54 and electromagnet 55 to frame 1.

The contact actuator 15 includes an L-shaped arm 16 which is rotatably mounted about a stationary shaft 3 through a boss 18 formed at one end of the arm 16, an actuator 20, and a driven gear 26. Two gears 17*a*, 17*b*, are fixedly mounted on a shaft 17 and are mounted on the other end of arm 16 for pivotal movement about shaft 3. A spring 19 is placed around boss 18 with a coil 19*b* wound about a lug 4 in a direction opposite to that of the spring 19. One end 19*a* of spring 19 urges the arm 16 in the direction shown by arrow A until restricted by face 16*b* abutting lever 63 of an electromagnet 55. The other end 19*c* of spring 19 is attached to a hole 31 formed on a plate 27 which is part of a driven gear 26, so as to urge the plate 27 in the direction shown by arrow A.

Actuator 20 includes actuating projections 21, (FIG. 2), 22 and a lug 23, and is rotatably mounted on the stationary shaft 5 and retained in position by an E-ring 32. The actuator 20 also includes a projection 25 which can be seen through an indication window 87 formed on the timing device 85 when the actuator 20 rotates after a preset time period has expired. The plate 27 and a cam 28 with a cut-out portion 28*a* are united with a driven gear 26 and are rotatably mounted on the stationary shaft 3 through a center hole 29.

Figure 2:
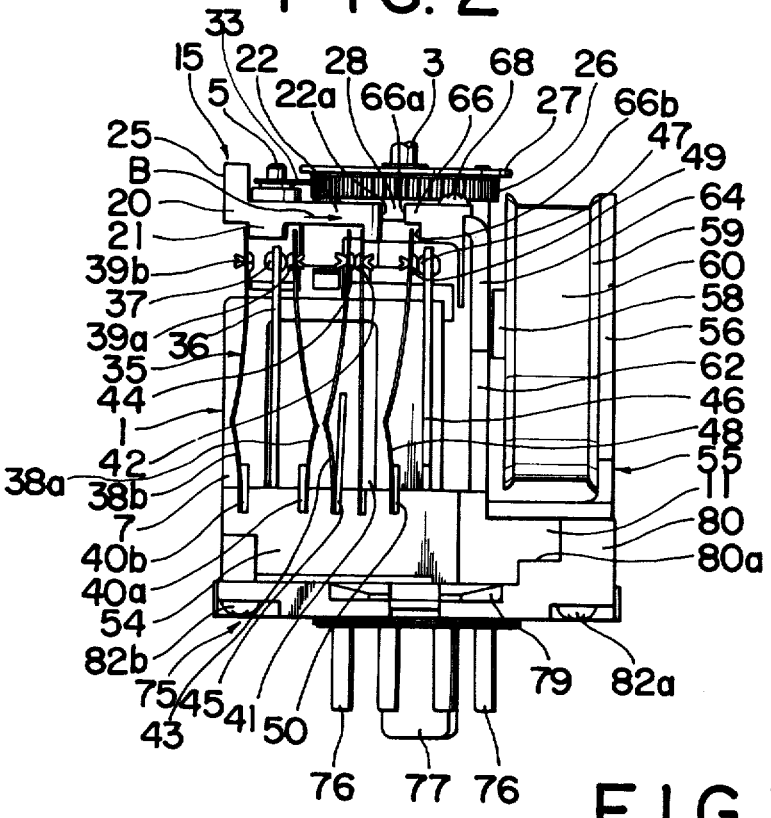
FIG. 2 is a front view of the timing device shown in FIG. 1.
Figure 3:
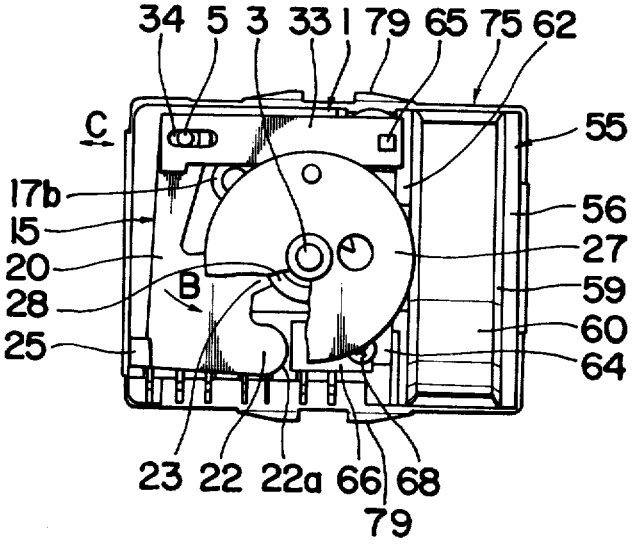
FIG. 3 is a top view of the timing device shown in FIG. 1 with a portion broken away.
Figure 4:
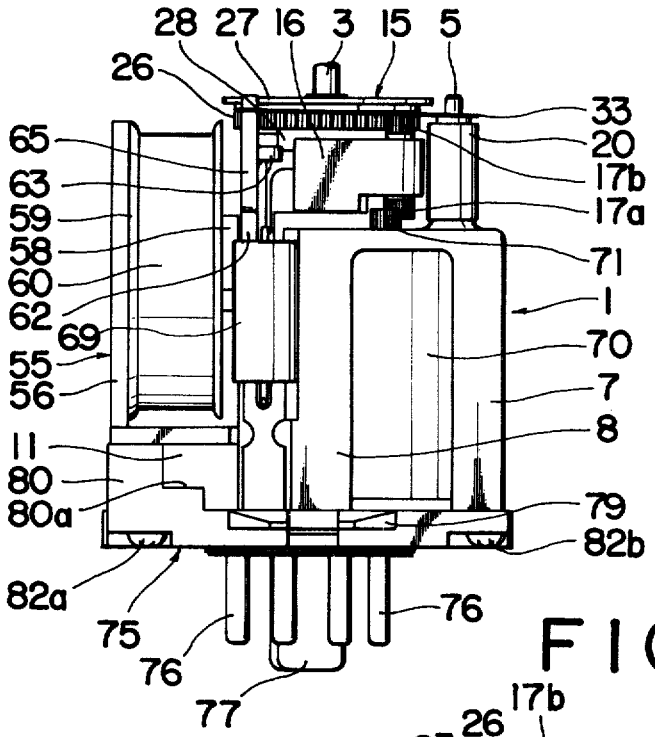
FIG. 4 is a rear view of the timing device shown in FIG. 1.
Figure 5:
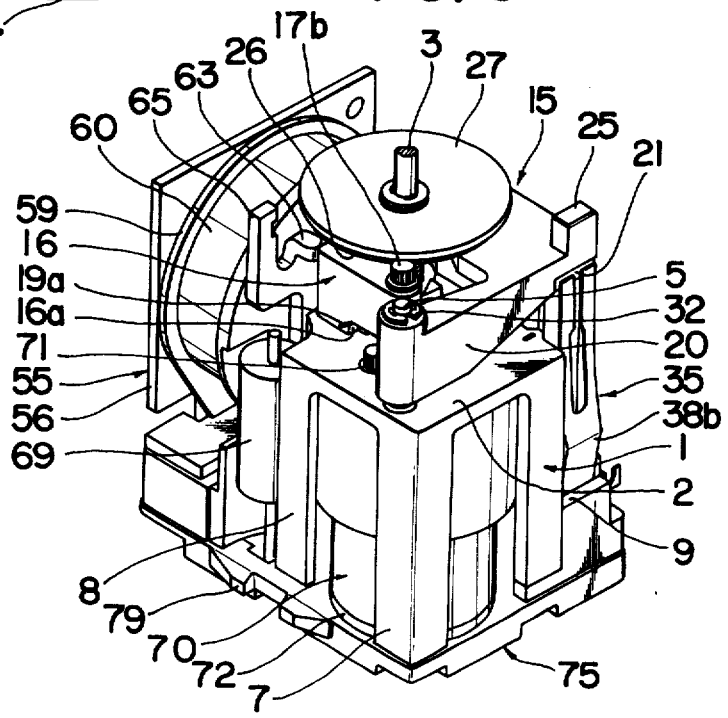
FIG. 5 is a perspective view of the timing device shown in FIG. 1.

As best seen in FIG. 2, a contact assembly 35 comprises a stationary blade 36 having a stationary contact 37, movable blades 38*a* and 38*b* having movable contacts 39*a* and 39*b* respectively, a movable blade 41 having a movable contact 42, a stationary blade 43 having a stationary contact 44, a stationary blade 46 having a stationary contact 47, and movable blade 48 having a movable contact 49. Stationary contact 37 and movable contacts 39*a* and 39*b* form timing contacts for the timing device, movable contact 42 and stationary contact 44 are connected in series with a synchronous motor 70 and thus control the supply of power thereto and stationary contact 47 and movable contact 49 form an instantaneous contact. Strengthening plates 40*a*, 40*b*, 45 and 50 are attached at lower portions of the stationary and movable blades 38*a*, 38*b*, 43 and 48 respectively. The stationary and movable blades 36, 38*a*, 38*b* 41, 43, 46, and 48 are press fitted in a plurality of grooves (not numbered) formed on the terminal holder 54 which is adapted for attachment to the attaching portion 9 of the frame 1. The strengthening plate 45 also functions as a stopper to restrict movement of the stationary blade 43.

Top portions of the movable blades 38*a*, 38*b*, which confront each other, are engageable with the actuating projection 21 (FIG. 2) of the actuator 20. The movable blade 41, having a top portion engageable with the actuating projection 22 of actuator 20, urges the actuator in the direction shown by arrow B.

The electromagnet comprises a yoke 56, a core 58 attached to the yoke 56, a spool 59, a coil 60, an armature 62 pivotably mounted on one end of said yoke 56, and a tension spring 61 biassing armature 62 away from core 68, i.e., in a counter-clockwise direction as viewed in FIG. 2. The electromagnet 55 is attached to the attaching portion 11 of the molded frame 1 and the molded frame 1 is attached to the base member 75. The electromagnet 55 is held to the base member 75 by two screws 82*a* with the attaching portion 11 sandwiched therebetween. The armature 62 includes lever portions 63, (FIGS. 1, 4 and 5), 64 (FIGS. 1, 2 and 3) and 65 (FIGS. 1, 3, 4 and 5). Lever portion 63 is engageable with the face 16*b* of the arm 16, and the lever portion 64 has mounted thereon an adjustment piece 66 having a slot 67 therein. Adjustment piece 66 is adjustable in the direction shown by arrow D. An end 66*a* of the adjustment piece 66 is engageable with an end 22*a* of the actuator 20, and a stepped portion 66*b* is engageable with a top portion of the movable blade 48 of the contact assembly 35.

A plate 33 (FIGS. 2, 3, 4) for displaying the snap action movement of the armature 62 is attached to the lever 65 at one end; a slot 34 is formed on the other end of the plate 33 in which stationary shaft 5 is inserted in order to guide the movement of the plate 33 in the direction shown by arrow C. The movement of plate 33 can be seen through an indicating window 88 formed on an upper surface 86 of the housing 85 thereby indicating whether the electromagnet 55 is energized or not.

The synchronous motor 70 includes a reduction gear system (not numbered) and a drive gear 71 projecting upwardly from the reduction gear system through hole 6 of mounting base 2, and is placed in a space 12 of the molded flame 1, with drive gear 71 being engageable with the gear 17*a*.

The base member 75 includes pin terminals 76, (FIGS. 2 and 4), a positioning projection 77 on a bottom side, and lead wires 78 on a top side which are connected to pin terminals 76. The base member is adapted to be mounted in a socket (not shown). The electromagnet 55 is held to the base member 75 by two screws 82*a* (FIG. 2) with the attaching portion 11 of the molded frame 1 sandwiched between the yoke 56 of the electromagnet 55 and a stepped portion 80*a* of the base member 75. Supporting portions 7 are also held to the base member 75 by two screws 82*b* (FIG. 2). A rubber plate 72 is placed between the synchronous motor 70 and the base member 75 for protecting the synchronous motor 70 from hitting base member 75.

Each of lead wires 78 is connected to one of the stationary or movable blades 36, 38*a*, 38*b*, 41, 43, 46, and 48. A resistor 69 is placed beside a supporting portion 8 of the molded frame 1, and is connected in circuit with synchronous motor 70.

A housing 85 is made of a one-piece plastic assembly and has a hole 101 formed in an upper surface 85. Stationary shaft 3 projects through hole 101 and has a knob (not shown) mounted thereon having a pointer for setting a desired time delay. The housing 85 covers the molded frame 1, and the two are locked together by projections 79 formed on the base member 75 which cooperate with slots 91 formed on the bottom portion of the housing 85.

Blades 46 and 48 are connected to two of the pin terminals 76 and serve to control a load (not shown). Similarly, blades 36, 38*a* and 38*b* are connected to another three of the pin terminals 76 and serve to control another load (not shown). Blades 41 and 43 are connected in series with the synchronous motor 70 with the series connection being connected with another two of the pin terminals 76 which have power applied thereto. Electromagnet 55 is connected in parallel with the series connection of synchronous motor 70 and blades 41 and 43.

Figure 9:
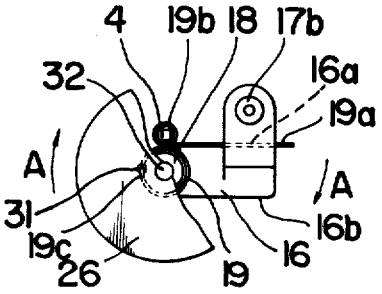

The operation of the aforementioned timing device is as follows:

When the power is turned off, the armature 62 of the electromagnet 55 is rotated counter-clockwise as viewed in FIG. 2, and the lever 63 pushes the arm 16 thereby rotating it in a direction opposite to that shown by arrow A (FIGS. 1, 9) so that the gear 17*a* is disengaged from the drive gear 71 while the gear 17*b* maintains its engagement with the driven gear 26. The actuator 20 is rotated in a direction opposite to that shown by arrow B as the end 22*a* is pushed by the adjustment piece 66 attached to the lever 64. As a result of the foregoing, contacts 37 and 39*a*, and contacts 42 and 44 are closed and contacts 37 and 39*b*, and contacts 47 and 49 are opened. For setting a delay time, the driven gear 26 is rotated via the knob (not shown) in a direction opposite to that shown by arrow A.

When power is applied to the electromagnet, armature 62 is attracted by the core 58 and rotates clockwise as viewed in FIG. 2, which releases the pressure on both the arm 16 and the actuator 20. As a result, the arm 16 is rotated by the spring 19 in the direction shown by arrow A about the stationary shaft 3 and the gear 17*a* engages with the drive gear 71 while the gear 17*b* maintains its engagement with the driven gear 26.

Additionally, the stepped portion 66*a* of the adjustment piece 66 releases its pressure on movable blade 48, resulting in a closing of contacts 47 and 49. Since contacts 42 and 44 are closed, the synchronous motor 70 starts to rotate. The rotation of the synchronous motor 70 is transmitted to the driven gear 26 through the gears 17*a* and 17*b* rotating the driven gear 26 in the opposite direction shown by arrow A against the spring force of spring 19. As the driven gear 26 rotates to a predetermined angle which was preselected by the knob in accordance with the desired delay; that is, the preset time expires, the lug 23 of the actuator 20 which slides on the cam 28 drops into the cut-out portion 28*a* of cam 28 so that the actuator 20 which is urged by the movable blade 41 rotates about the stationary shaft 5 in the direction shown by arrow B. As a result of this rotation of the actuator 20, movable contact 39*a* breaks contact with stationary contact 37; the movable contact 39*b* makes contact with the stationary contact 37; and the contact between contacts 42, and 44 is opened to thereby stop the synchronous motor 70.

Since the power is now turned off, the armature 62 rotates counter-clockwise as viewed in FIG. 2 and returns to the first position pushing back both the arm 16 and the actuator 20 to their first positions. Thus, gear 17*a* is disengaged from the drive gear 71, contacts 39*b* and 37, and contacts 47 and 49 are respectively opened, and contacts 42 and 44 are closed.

Figure 6:
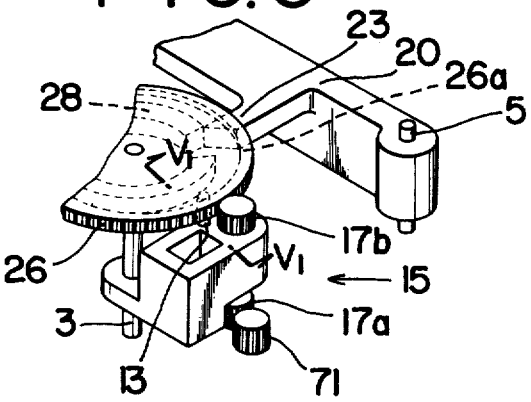
FIG. 6 is a perspective view of the clutch means embodying an improved coupling between a driven gear and a motor.
Figure 7A:
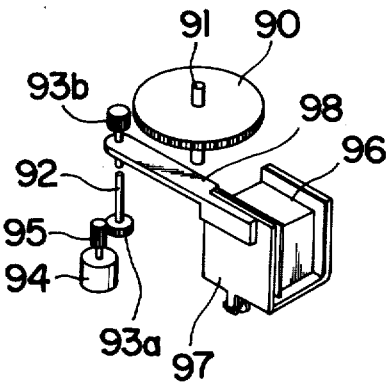
FIG. 7a PRIOR ART
FIGS. 7*a* and FIG. 7*b* are perspective views of the clutch means utilized in prior art timing devices.
Figure 8A:
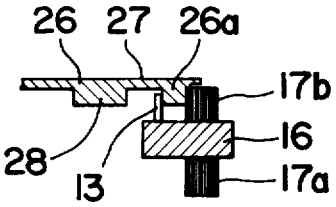
FIGS. 8*a*, 8*b*, and 8*c* are sectional views, on an enlarged scale, on a further improved clutch means; and, FIG. 9 is a schematic top view showing a spring and related parts embodied in the timing device shown in FIG. 1.
Figure 7B:
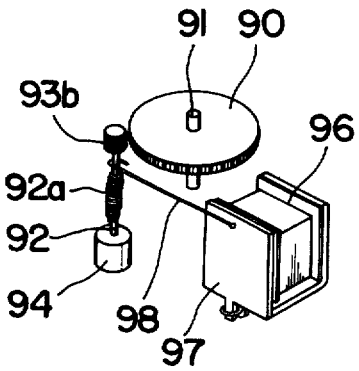
FIG. 7b PRIOR ART
Figure 8B:
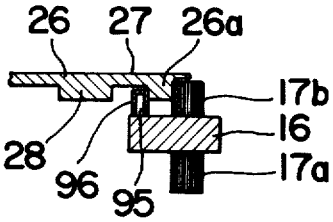
Figure 8C:
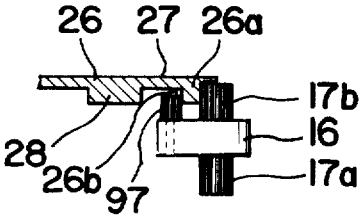

In order to make the clutch action more reliable, the arm 16 may further include a projections 13 (FIG. 6) beside the gear 17*b*. The distance between the projection 13 and the gear 17*b* is made about equal to a thickness of the teeth portion 26*a* of the driven gear 26, so that the teeth portion 26*a* is slidable between the projection 13 and the gear 17*b*. With this construction, the engagement of the gear 17*b* with the driven gear 26 is insured even if a precise fit between the boss 18 of the arm 16 and the stationary shaft 3 is not obtained. The projection 13 may be composed of pin as illustrated in FIGS. 6 and 8*a*, a roller 96 as shown in FIG. 8*b*, or a gear 97 as shown in FIG. 8*c*. If gear 97 is utilized, an internal gear 26*b* shaped inside the teeth portion 26*a* of driven gear 26 is preferable for engagement with the gear 97.

In order to further improve reliability of the clutch action, the arm 16 is also provided with one or more projections 14*a* and 14*b* which are slidable on the mounting base 2 and which are parallel to the stationary shaft 3. Projections 14*a* and 14*b* prevent the arm 16 from inclining when it rotates. The projection 14*a* works when the arm 16 rotates in the direction shown by arrow A while the projection 14*b* works when the arm 16 rotates in the opposite direction shown by arrow A. With the projection 14*a* and 14*b*, the arm 16 rotates without inclination or tilting and the engagement of gear 17*a* with the drive gear 71 and gear 17*b* with the driven gear 26 is stable and firm.

Although a particular embodiment of the invention has been described in detail with reference to the accompanying drawings, it is to be understood that the invention is not limited to the precise embodiment disclosed and that various changes and modifications may be readily effected by one skilled in the art without departing from the spirit or scope of the invention which is defined solely by the appended claims.

What is claimed is:

1. A timing device comprising:

A motor having an output shaft;

a driven element having a cam surface mounted thereon, said cam surface including an actuating portion;

a clutch means comprising a first gear selectively engageable with said output shaft and a second gear continuously engaged with said driven element for moving the same, said first and second gears being mounted on a common shaft;

an arm rotatably mounted holding said first and second gears;

means for rotatably biasing said arm to a position at which said motor output shaft and first gear engage;

electromagnet means having an armature which normally pressably rotates said arm against the force of said biasing means to a position at which said motor output shaft disengages from said first gear;

a switching element for selectively supplying power to said motor when actuated;

means engaged with said cam surface and initially moved by a first movement of said armature for actuating said switching element, said means for actuating being further moved by said actuating portion of said cam surface to deactuate said switching element;

means for initially rotating said driven element a desired amount to set a delay time; and means for supplying power to said electromagnet means and switching element to cause said first movement of said armature and the release of the armature pressing force against said arm to thereby allow said arm to rotate in response to said biasing means to said position at which said motor output shaft and first gear engage.

2. A timing device as in claim 1, wherein said arm is provided with a projection located adjacent said second gear for holding a gear engaging portion of the driven element between said projection and said second gear.

3. A timing device as in claim 2, wherein said projection is a roller.

4. A timing device as in claim 2, wherein said projection is a third gear, and said driven gear is provided with an internal gear for engagement with said third gear.

5. A timing device as in claim 1, wherein said arm is mounted on a shaft projecting from a mounting base and wherein said arm is further provided with at least one projection, said projection being slidable on said mounting base.

6. A timing device as in claim 1, wherein said means for biasing also urges said driven gear to a predetermined rest position.

7. A timing device as in claim 6, wherein said arm is mounted on a shaft projecting from a mounting base and said means for biasing is a spring provided with a coil at a bottom portion thereof, said coil being wound in the direction opposite to that of the spring and engaging a projection on said mounting base.

8. A timing device as in claim 1, wherein said armature has an adjustable projection for engaging with said means for actuating.

9. A timing device as in claim 1 wherein said actuating portion is a hole in said cam surface and said means for actuating contains a projection which engages with said cam surface.

* * * * *